US007367684B2

(12) United States Patent
D'Souza

(10) Patent No.: US 7,367,684 B2
(45) Date of Patent: May 6, 2008

(54) JEWELRY WITH BATTERY POWERED ILLUMINATION

(76) Inventor: Ian C. D'Souza, 250 Mercer St., Apt. C315, New York, NY (US) 10012

( * ) Notice: Subject to any disclaimer, the term of this patent is extended or adjusted under 35 U.S.C. 154(b) by 88 days.

(21) Appl. No.: 11/016,464

(22) Filed: Dec. 16, 2004

(65) Prior Publication Data

US 2006/0133066 A1 Jun. 22, 2006

(51) Int. Cl.
*F21V 21/08* (2006.01)

(52) U.S. Cl. ..... 362/104; 362/103; 63/3.1; 63/3

(58) Field of Classification Search ..... 362/103, 362/571, 104; 340/326; 63/3
See application file for complete search history.

(56) References Cited

U.S. PATENT DOCUMENTS

| | | | | | |
|---|---|---|---|---|---|
| 2,615,227 | A | * | 10/1952 | Hornik | 24/303 |
| 4,093,973 | A | * | 6/1978 | Vaagenes | 362/104 |
| 4,237,525 | A | | 12/1980 | Deter | 362/104 |
| 4,942,744 | A | | 7/1990 | Wei | 63/26 |
| 5,001,462 | A | * | 3/1991 | Seemann et al. | 340/574 |
| 5,323,300 | A | | 6/1994 | McCray | 362/104 |
| 5,367,891 | A | * | 11/1994 | Furuyama | 63/29.2 |
| 5,497,307 | A | | 3/1996 | Bae et al. | 362/104 |
| 5,519,591 | A | | 5/1996 | McCray | 362/104 |
| 5,622,062 | A | | 4/1997 | Gong-Hwa | 63/15 |
| 5,653,524 | A | | 8/1997 | Gray | 362/104 |
| 5,859,582 | A | * | 1/1999 | Yuen | 340/326 |
| 5,876,109 | A | | 3/1999 | Scalco | 362/104 |
| 5,928,834 | A | * | 7/1999 | Koenigkramer et al. | 430/259 |
| 6,050,695 | A | | 4/2000 | Fromm | 362/104 |
| 6,122,933 | A | * | 9/2000 | Ohlund | 63/3 |
| 6,166,496 | A | | 12/2000 | Lys et al. | 315/316 |
| 6,233,971 | B1 | * | 5/2001 | Ohlund | 63/3 |
| 6,296,364 | B1 | * | 10/2001 | Day et al. | 362/104 |
| 6,433,483 | B1 | | 8/2002 | Michael et al. | 315/76 |
| 6,601,965 | B2 | * | 8/2003 | Kamara | 362/104 |
| 6,626,009 | B1 | * | 9/2003 | Ohlund | 63/3.1 |
| 6,659,617 | B1 | | 12/2003 | Michael | 362/104 |
| 6,833,539 | B1 | * | 12/2004 | Maeda | 250/214 AL |
| 7,000,428 | B2 | * | 2/2006 | Kamara et al. | 63/3 |
| 2004/0196650 | A1 | * | 10/2004 | Phlippeau | 362/103 |
| 2006/0007668 | A1 | * | 1/2006 | Chien | 362/103 |

FOREIGN PATENT DOCUMENTS

EP 1 327 395 A2 7/2003

* cited by examiner

*Primary Examiner*—Anabel M Ton
(74) *Attorney, Agent, or Firm*—Nixon Peabody LLP

(57) ABSTRACT

An article of illuminated jewelry includes at least one light source, preferably comprising an LED, a housing preferably in a circumferential shape, and having a hollow core for placing at least one wire for supplying power from a battery to the light source for illuminating a decorative object. The housing also includes a battery compartment positioned at a predetermined distance from said light source for enclosing the battery. The invention relates generally to jewelry and more particularly to illuminated jewelry, including but not limited to rings, necklaces and bracelets. The article of illuminated jewelry may include, for example, the use of multiple batteries of different types, different placements and sizes of batteries (for brighter or longer illumination) as well as various alternative switch mechanisms. The one or more light sources can also generate different colors of light.

7 Claims, 4 Drawing Sheets

JEWELRY WITH BATTERY POWERED ILLUMINATION

FIELD OF THE INVENTION

The invention relates generally to jewelry and more particularly to illuminated jewelry, including but not limited to rings, necklaces and bracelets.

BACKGROUND OF THE INVENTION

Jewelry with an illuminating light to enhance the appearance of a decorative object, such as a precious stone or the like, have been created in various shapes, forms, and styles, but in the past such jewelry has been mostly targeted to a consumer market comprising costume or low-cost jewelry. This is primarily because the energy source for the lights is usually provided by one or more batteries which are bulky and not easy to incorporate into a jewelry piece.

One challenge in designing aesthetically attractive illuminated jewelry is the placement of the battery. In one conventional design, as described in U.S. Pat. No. 6,601,965 a necklace is formed from a loop of insulated wire having a battery positioned at a fixed location within a first discontinuity of the wire and a light source located at a second discontinuity. In another conventional design, as disclosed in U.S. Pat. No. 5,876,109, a battery cell is mounted in a threaded cap housing that is screwed on to an ornament housing that contains the light emitting diode. These prior illuminated jewelry designs tend to be bulky or place significant restrictions on the structure of the jewelry design.

Contemporary fashion designers are constantly seeking for ways to accentuate the beauty and brightness of jewelry or otherwise make stones such as quartz more visually appealing. As fashion trends continue to evolve rapidly from year to year, the fashion industry must be creative to come up with new and fresh jewelry designs, colors, and shapes in order to provide new jewelry products. Accordingly, there is an ongoing need to create new and different structural designs of illuminated jewelry. Decorative objects contemplated as being mounted on the jewelry housing include diamonds, semi-precious stones such as quartz, and pearls. There is a further need for jewelry targeted to a higher end market wherein key structural constraints and limitations of prior art generally aimed at low end and costume jewelry have been eliminated.

SUMMARY OF THE INVENTION

The present invention is an article of illuminated jewelry which includes a housing in a preferably circumferential shape having a hollow core containing at least one conductor for supplying power from a battery to a light source positioned on said housing to illuminate a decorative object.

Broadly stated, in a first embodiment, an article of jewelry on which a decorative object may be mounted, comprises a light source; a housing having a pad on which said decorative object is to be mounted and a holder for said light source, the light source positioned thereby to enable the light source to illuminate said decorative object; a battery compartment on said housing at a predetermined distance from said light source holder for enclosing a battery; and means for coupling power from the battery in said battery compartment to said light source, comprising at least one electrical conductor routed at least in part through a hollow core formed in said housing for connecting said battery to said light source. According to the present invention, the abovereferenced predetermined distance is a flexible and not fixed distance between the battery and light source, and can be altered depending on the particular jewelry design.

In a second embodiment, an article of jewelry on which a decorative object may be mounted, comprises a light source; a housing having a circumferential shape and having a pad on which said decorative object is to be mounted and a holder for said light source, said light source positioned thereby to enable said light source to illuminate said decorative object; a battery compartment on said housing spaced a predetermined distance from said light source holder and said decorative object for enclosing a battery; and means for coupling power from said battery in said battery compartment to said light source, comprising at least one electrical conductor routed through a hollow core formed in said housing for connecting between said battery and said light source; wherein said housing includes a clasp having two parts, a male portion and a female portion, said female portion including a first slot and a second slot, such that when the male portion of the clasp is selectively inserted in said first slot, power is coupled from said battery to said light source, and when the male portion of the clasp is selectively inserted in said second slot, no power is coupled to said light source.

In a third embodiment, an article of jewelry on which a decorative object may be mounted, comprises a light source; a housing having a circumferential shape and having a pad on which said decorative object is to be mounted, a first holder located at a first end of said decorative object for insertion of a first light source, and a second holder located at a second end of said decorative object for insertion of a second light source, said first and second light sources positioned thereby to enable said first and second light sources to illuminate said decorative object; a battery compartment on said housing spaced a predetermined distance from said first and second light source holders for enclosing a battery; and means for coupling power from a battery in said first and second battery compartment to said first and second light sources, comprising at least one electrical conductor routed through a hollow core formed in said housing for connecting said battery to said light source; and a four position switch, said switch in said second position coupling said battery to said first light source, said switch in said third position coupling said battery to said second light source said switch in said fourth position coupling said battery to both said first light source said switch in said first position coupling said battery to neither said non said second light source and said first light source and said second light source.

In a fourth embodiment, an article of jewelry on which a decorative object may be mounted, comprising: a light source; a housing shaped to be mounted on a necklace at a first end and having a second end with a pad on which said decorative object is to be mounted and a holder for said light source, said light source positioned thereby to enable said light source to illuminate said decorative object; a battery compartment in said housing at said first end for enclosing a battery; and means for coupling power from said battery in said battery compartment to said light source, comprising at least one electrical conductor for connecting between said battery and said light source, said conductor routed at least in part through a hollow core in said housing between said first and said second end.

The structures and methods regarding the present invention are disclosed in the detailed description below. This summary does not purport to define the invention. The invention is defined by the claims. These and other embodiments, features, aspects, and advantages of the invention will become better understood with regard to the following description, appended claims and accompanying drawings.

Reference symbols or names are used in the Figures to indicate certain components, aspects or features therein, with reference symbols common to more than one Figure indicating like components, aspects or features shown therein.

DETAILED DESCRIPTION OF PREFERRED EMBODIMENTS

Figure 1:
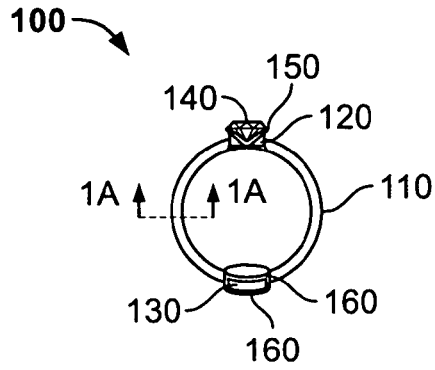
FIG. 1 is a side view of a ring with battery powered illumination in accordance with the present invention.
Figure 1A:
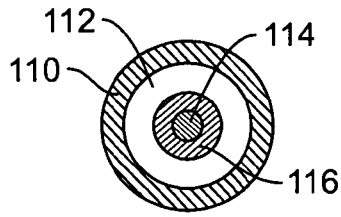
FIG. 1A is cross-sectional view of the ring housing shown in FIG. 1 taken along the lines 1A-1A.
Figure 2:
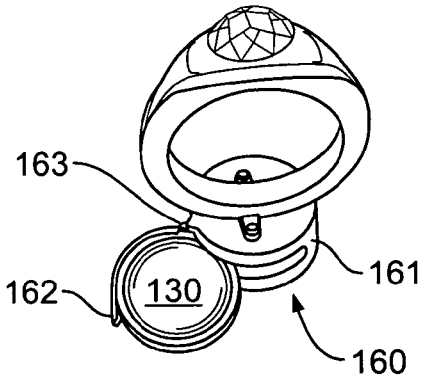
FIG. 2 is a perspective view of the ring as shown in FIG. 1 in accordance with the present invention, showing the battery compartment open and a battery placed therein.

Referring now to FIG. 1, there is shown a perspective view of a ring 100 comprising a housing 110 having a circumferential shape with a hollow interior or core 112, as seen in the cross-sectional view shown in FIG. 1A along at least a portion of the circumference. Hollow core 112 enables at least one electrical conductor 114 to be routed therein to provide a conductive path between a battery 130 and a light source 120 mounted on said housing. The conductor 114 needs to have an insulated jacket (shown at 116 in FIG. 1A) when housing 110 is a conductive metal.

A battery compartment 160 is attached to the housing 110 and functions as an enclosure for battery 130 and is positioned at a predetermined distance (e.g., at the side opposite the light source 120). A decorative object 140 is mounted on a pad or raised prongs 150 formed on housing 110 and accessible to the hollow core 112 of the housing 110. The light source 120 is positioned on or in the pad, or below or alongside the raised prongs 150, such that the light source 120 shines diagonally or vertically around (and through, if the object is translucent) the decorative object 140. The light source 120 can be implemented using a conventional light-emitting diode (LED).

Figure 3:
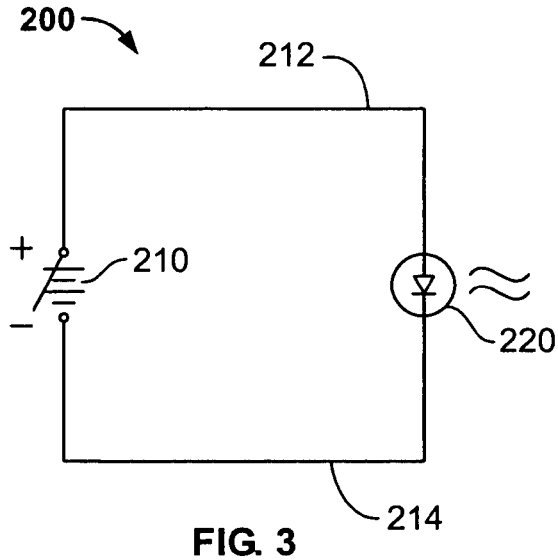
FIG. 3 is a circuit diagram for supplying battery power to a light emitting diode on the ring of FIG. 1 in accordance with the present invention.

The battery compartment 160 preferably comprises two parts, as best seen in FIG. 3: a cup 162 in which a conventional disk shaped battery is designed to be placed, and a battery enclosure 161 in which the cup 162 and battery 130 are inserted. Preferably, cup 162 is connected to battery enclosure 161 by a conventional hinge 163. Hinge 163 enables a user to swing open the cup 162 from battery enclosure 161 for placement or replacement of battery 130. Battery 130 is electrically and mechanically coupled to at least one wire conductor in the hollow core of housing 110 when the battery 130 and cup 162 are closed within battery enclosure 161. A conventional latch (not shown) is preferably used to retain cup 162 and battery 130 in battery enclosure 161. The battery compartment 160 also preferably has a flat surface 164 on its bottom so that the ring 100 can stand vertically when placed on a surface, such as a table.

Housing 110 in the present invention preferably is formed from a precious metal and the decorative object 140 is preferably a high-quality piece of jewelry, such as a diamond or other translucent jewel. A suitable material for housing 110 includes platinum, gold, steel, or silver.

FIG. 3 illustrates a circuit 200 for supplying power to the ring 100 shown in FIG. 1. The circuit 200 comprises a battery 210 and a light-emitting diode 220. When the battery 130 is enclosed within battery compartment 160, the circuit 200 is in a closed-loop, i.e., battery 130 is electrically coupled to light source 120. When battery 130 has been placed inside the battery compartment 160, the light-emitting diode 220 will be turned on and will illuminate the decorative object 140.

Battery 210 has two terminals, a+terminal and a−terminal. The light emitting diode 220 is coupled to the terminals of battery 210 preferably by separate wires 212 and 214 for connecting to the cathode and anode of diode 220. Each wire is preferably routed through a different portion of the hollow core 112 of housing 110. Alternatively, if housing 110 is a conductive metal, one of the wires 212 or 214 can be eliminated by having housing 110 provide one of the conducting paths between a terminal of battery 210 and diode 220.

Figure 4:
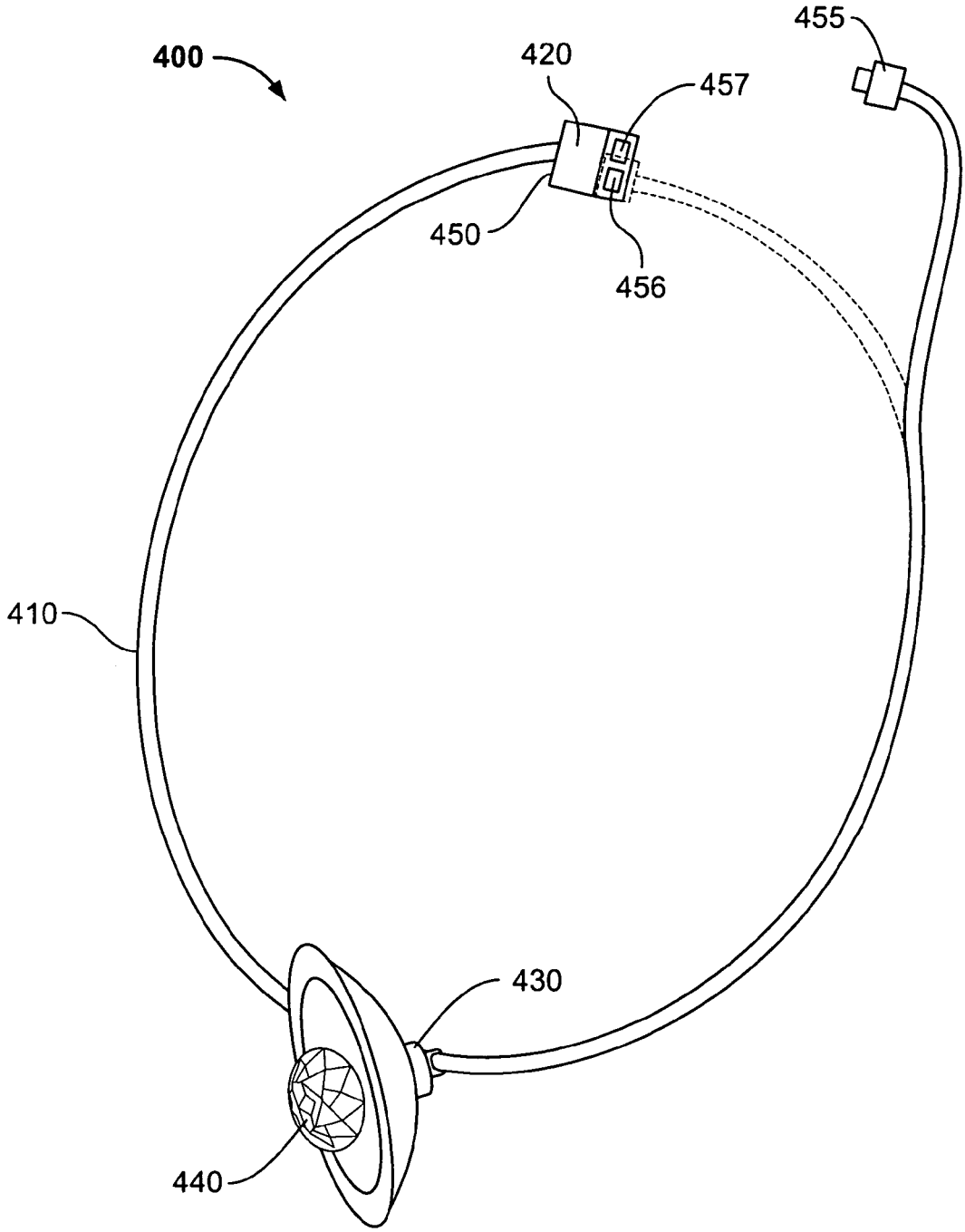
FIG. 4 is a perspective view of a necklace with battery powered illumination in accordance with the present invention.
Figure 5:
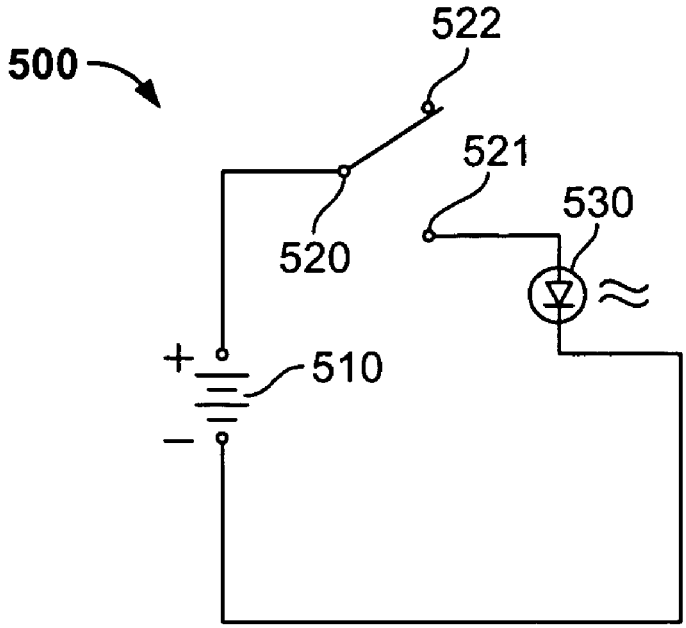
FIG. 5 is a circuit diagram for supplying battery power to a light emitting diode on the necklace of FIG. 4 in accordance with the present invention.

FIG. 4 is a perspective view of a necklace 400 with battery powered illumination. Necklace 400 includes a housing 410 having a circumferential shape with a hollow core along at least a portion of said circumference that allows at least one electrical conductor to connect between a battery 420 and a light source 430. The housing 410 is designed to have a decorative object 440 attached thereto. Decorative object 440 may again be opaque or translucent, e.g., a pearl or a diamond. Housing 410 also includes a clasp 450 spaced from object 440 preferably at the opposite end of housing 410. Clasp 450 can function like any conventional necklace clasp to enable the necklace housing to be fastened around a user's neck. In the preferred embodiment, clasp 450 includes a switch function. Specifically, clasp 450 preferably includes two parts, a male portion 455 on the one end, and a first slot 456 and a second slot 457 on the other end. When the male portion 455 is inserted into the first slot 456, a circuit 500 described below is closed and battery 420 supplies power to turn on the light source 430. When the male portion 455 is inserted into the second slot 457, the circuit 500 is not closed and battery 420 does not supply power to the light source 430. The clasp 450 in the necklace 400 therefore acts as a switch 520 to connect or disconnect the battery to the LED in circuit 500 as shown in FIG. 5. The use of the clasp 450 to create the switch in circuit 500, effectively turning on or turning off the light source 430, is also applicable to other types of jewelry, such as a bracelet.

In one embodiment according to the present invention, the clasp 450 serves to house the battery 420 as well as to secure the necklace 400 when the male portion 455 is selectively inserted into either the first slot 456 or the second slot 457. In an alternative embodiment, not shown, the battery 420 can be mounted outside of the clasp 450 along housing 410. The battery 420 is fastened to the housing 410 at some distance away from the light source 430, e.g., the battery 420 is located approximately on the opposite side of the housing 410 from the light source 430. The light source 430 is placed behind or adjacent to the decorative object 440 for illuminating around and/or through the decorative object 440.

FIG. 5 is a circuit diagram 500 for implementing the necklace 400 with battery powered illumination as described with respect to FIG. 4. The circuit 500 comprises a battery 510, a two-position switch 520, and a light-emitting diode 530. The two-position switch 520 has a first switch position 521 that corresponds to the function when the male portion 455 is connected into first slot 456, and a second switch position 522 that corresponds into function when the male portion 455 is connected to the second slot 457. In other words, if the switch control 520 is placed in the first switch position 521, the circuit 500 is in a closed loop so that the battery 510 is able to supply power to the light source 530. If the switch control is placed in the second switch position 522, battery 510 is not coupled to the light source 530. Battery 510 provides the electrical power necessary to turn on the light-emitting diode 530. In a situation where the voltage of the battery 510 is comparable to the voltage to the light-emitting diode 530, there is no need to add a resistor in the circuit 500. However, a resistor may be necessary in the circuit 500 where the voltage of the battery 510 is higher than the voltage desired by the light-emitting diode 530.

The switch 520 can also be implemented for the necklace 400 using a large number of other mechanisms conventionally known in the art. These switch mechanisms are also useable in any other articles of jewelry according to the present invention. The switch, for example, may comprise the same type of switch found in watches, wherein the switch function is obtained by the repositioning of a shaft connected to a knob or button accessible to a user. Such mechanisms are typically waterproof and resilient.

Figure 6:
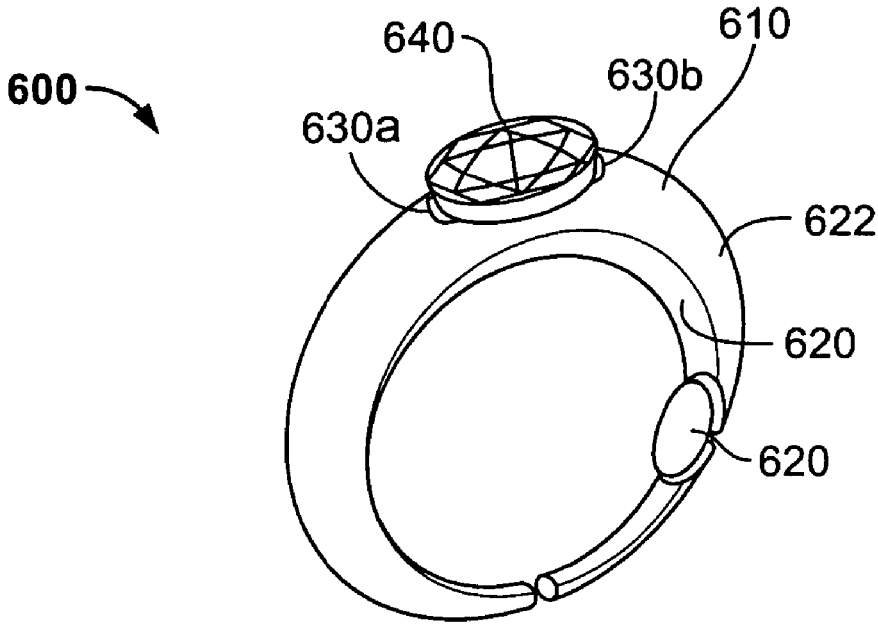
FIG. 6 is a perspective view of a bracelet with battery powered illumination in accordance with the present invention.

Referring now to FIG. 6, there is shown a perspective view of a bracelet 600 having a housing 610 having a circumferential shape with a hollow core along at least a portion of said circumference that allows at least one electrical conductor positioned in said hollow core to connect between a battery 620 and one or more light sources 630*a* and 630*b*. The battery 620 is fastened along housing 610 at some distance from the one or more light sources 630*a* and 630*b*. A battery compartment 625 has one or more switches 627 for switching on or off the one or more light sources 630*a* and 630*a*. For example, if two switches are included in the design, four possible logic combinations are available: (1) both switches 627 are off, so that no power is supplied to the first light source 630*a* or the second light source 630*b*, (2) a first switch is on to couple power the first light source 630*a* only, (3) a second switch is on to couple power the second light source 630*b* only, and (4) both switches are on to couple power the first light source 630*a* and the second light source 630*b*.

The housing 610 includes an inside 620 surface (i.e., next to the skin of the wearer) and an outside surface 622. In this embodiment, a decorative object 640 is placed on the outside surface 622, with first light source 630*a* on the left side of the decorative object 640 and second light source 630*b* on the right side of the decorative object 640. In this embodiment, battery 620 is mounted on the inside surface 620.

Figure 7:
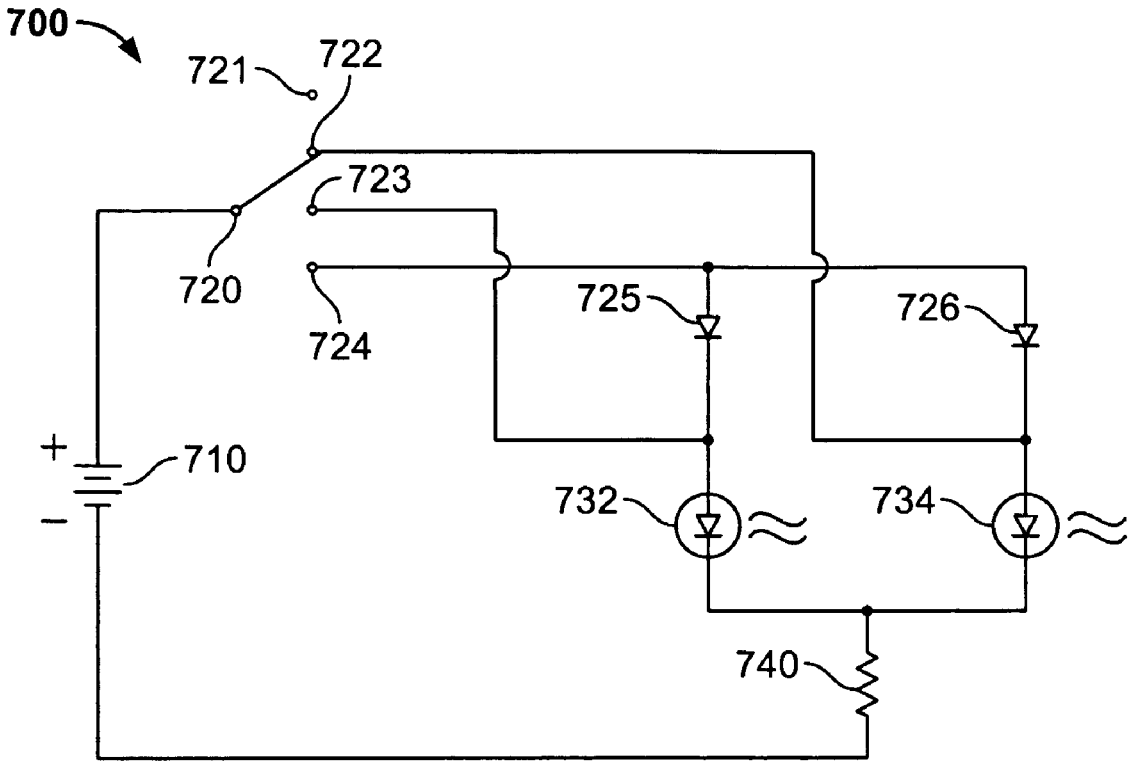
FIG. 7 is a circuit diagram for supplying battery power to a light emitting diode on the bracelet of FIG. 6 in accordance with the present invention.

FIG. 7 is a circuit diagram 700 for implementing the bracelet 600 with battery powered illumination as described with respect to FIG. 6. The circuit 700 comprises a battery 710, a four-position switch 720, and a light-emitting diode package including a first light-emitting diode 732 and a second light-emitting diode 734. The four-position switch 720 produces four possible switch positions: (1) a first switch position 721 where both the first light-emitting diode 732 and the second light-emitting diode 734 are off, (2) a second switch position 722 where only the first light-emitting diode 732 is turned on, (3) a third switch position 723 where only the second light-emitting diode 734 is turned on, and (4) a fourth switch position 724 where both the first light-emitting diode 732 and the second light-emitting diode 734 are turned on through a third diode 725 and a fourth diode 726. A resister 740 may be added to provide bias for light emitting diodes 732 and 734, depending on the voltage of battery 710.

In this embodiment, the first light-emitting diode 732 is selected to be a blue color, while the second light-emitting diode 734 selected to be a green color. One of ordinary skill in the art will recognize that other colors, such as red and purple, or any other combination of colors are possible depending on the design of the bracelet 600. Moreover, the location of the light-emitting diodes 732 and 734 are intended as an illustration. Other patterns of LED arrangements can be made without departing from the spirit of the present invention. Furthermore, more than two light-emitting diodes can be used in the design of the bracelet 600. The multiple switch positions and the multiple light emitting diodes in the bracelet 600 are also applicable to the design of a ring 100 or a necklace 400 according to the present invention.

Figure 8:
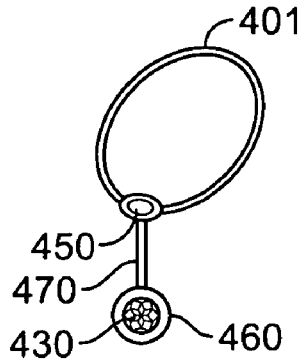
FIG. 8 is a perspective view of an alternative embodiment of a necklace with battery powered illumination in accordance with the present invention.

An alternative structural design of a pendant for a necklace 401 according to the present invention is shown in FIG. 8. As shown, the pendant housing 470 is fastened to necklace 401. The first end 450 of housing 470 is attached to the necklace and also contains a replaceable battery, not shown. The decorative object 440 is mounted to the second end 460 of housing 470 and is illuminated by an LED 430 (not shown) mounted behind object 440 in the same manner as in the housing shown in the other FIGURES herein, with the LED powered by the battery via one or two wires routed in a hollow core of housing 470 between the battery and decorative object 440.

The term "decorative object" is to be construed broadly throughout this invention to mean any article or material having optical reflective and/or refractive properties, whether translucent or non-translucent, including jewels, gemstones, decorated stones, transmissive light objects, precious stones, pearls, glass, plastic, and any aesthetically pleasing object, e.g. white and color diamonds (yellows, reds, pinks, purples, blues and greens), rubies, semi-precious stones, quartz, sapphires, emeralds, shells, turquoise, coral, and imitations of these stones made from artificial materials or small reflective metallic objects. In particular, the placement of a light behind a pearl or the placement of a light behind a piece of quartz may create refracted illumination through the gem due to its natural inclusions (as opposed to simply the cut of the gemstone).

Optionally, the article of jewelry according to the present invention can include the use, for example, of multiple batteries or different types and sizes of batteries for brighter or longer illumination. The one or more light sources can also generate different colors of light. Alternatively, the jewelry could comprise decorative ornaments to be hung on clothing apparel, trees or chandeliers.

In addition, the term "circumferential shape" as used in this application is to be construed broadly to include various geometric shapes, such as a circle, a square, or a rectangle.

Those skilled in the art can now appreciate from the foregoing description that the broad techniques of the embodiments of the present invention can be implemented in a variety of forms. Although the present invention describes three types of jewelry, including a ring embodiment, a necklace embodiment, and a bracelet embodiment, other type of jewelry can be implemented without departing from the spirit of the present invention, such as collars, key chains or cuff links. Therefore, while the embodiments of this invention have been described in connection with particular examples thereof, the true scope of the embodiments of the invention should not be so limited since other modifications, whether explicitly provided for by the specification or implied by the specification, will become apparent to the skilled practitioner upon a study of the drawings, specification, and following claims.

I claim:

1. An article of jewelry on which a decorative object may be mounted, comprising:

a light source;

a housing having a circumferential shape and having a pad on which said decorative object is to be mounted and a holder for said light source, said light source positioned thereby to enable said light source to illuminate said decorative object;

a battery compartment on said housing spaced a predetermined distance from said light source holder and said decorative object for enclosing a battery; and means for coupling power from said battery in said battery compartment to said light source, comprising at least one electrical conductor routed at least in part through a hollow core formed in said housing for connecting between said battery and said light source;

wherein said housing includes a clasp having two parts, a male portion and a female portion, said female portion including a first slot and a second slot, such that when the male portion of the clasp is selectively inserted in said first slot, power is coupled from said battery to said light source, and when the male portion of the clasp is selectively inserted in said second slot, no power is coupled to said light source.

2. The article of claim 1, wherein the battery compartment is positioned on the opposite side of said housing from said light source.

3. The article of claim 1, wherein said housing is a conductive metal and wherein said means for coupling power further comprises electrically coupling one terminal of the battery to said light source through said conductive metal.

4. The article of claim 1, wherein said means for complying power further comprises a second conductor for connecting said battery to said light source, said second conductor routed at least in part through a portion of said hollow core formed in said housing different from said one electrical conductor.

5. The article of claim 1, wherein the housing is formed in the shape of a bracelet.

6. The article of claim 1, wherein the housing is formed in the shape of a necklace.

7. The article of claim 1, wherein the housing is made of a precious metal.

* * * * *